US006274192B1

(12) United States Patent
Falkowski et al.

(10) Patent No.: US 6,274,192 B1
(45) Date of Patent: Aug. 14, 2001

(54) AQUEOUS CONCRETE PARTING AGENTS

(75) Inventors: Juergen Falkowski, Manheim; Stephan Heck, Pulheim; Norbert Huebner; Ingo Wegener, both of Duesseldorf, all of (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/254,620

(22) PCT Filed: Sep. 8, 1997

(86) PCT No.: PCT/EP97/04870

§ 371 Date: Mar. 11, 1999

§ 102(e) Date: Mar. 11, 1999

(87) PCT Pub. No.: WO98/12032

PCT Pub. Date: Mar. 26, 1998

(30) Foreign Application Priority Data

Sep. 17, 1996 (DE) ..... 196 37 841

(51) Int. Cl.[7] ..... B05D 1/02

(52) U.S. Cl. ..... 427/133; 427/421; 106/38.22; 106/287.26

(58) Field of Search ..... 106/38.22, 287.26; 427/421, 133; 264/334

(56) References Cited

U.S. PATENT DOCUMENTS

| | | | | |
|---|---|---|---|---|
| 5,374,716 | | 12/1994 | Biermann et al. | 536/18.6 |
| 5,466,746 | * | 11/1995 | Geck et al. | 524/837 |
| 5,494,938 | | 2/1996 | Kawa et al. | 514/786 |
| 5,576,425 | | 11/1996 | Hill et al. | 536/18.6 |
| 5,631,357 | * | 5/1997 | Weuthen et al. | 536/18.6 |
| 5,672,781 | | 9/1997 | Koehler et al. | 568/885 |
| 5,709,739 | | 1/1998 | Wittich et al. | 106/38.22 |

FOREIGN PATENT DOCUMENTS

| | | |
|---|---|---|
| 290 439 | 5/1991 | (DE) . |
| 40 33 928 | 4/1992 | (DE) . |
| 43 35 781 | 4/1995 | (DE) . |
| 43 38 974 | 5/1995 | (DE) . |
| 44 00 272 | 7/1995 | (DE) . |
| 44 22 858 | 7/1995 | (DE) . |
| 44 25 180 | 1/1996 | (DE) . |
| 195 29 907 | 2/1997 | (DE) . |
| 196 07 977 | 9/1997 | (DE) . |
| 0 301 298 | 2/1989 | (EP) . |
| 0 561 465 | 9/1993 | (EP) . |
| 1 294 038 | 10/1972 | (GB) . |
| WO86/07003 | 12/1986 | (WO) . |
| WO90/03977 | 4/1990 | (WO) . |
| WO95/18704 | 7/1995 | (WO) . |

OTHER PUBLICATIONS

Forster et al., Finely Particulate Emulsion–Containing Sugar Surfactants, DE 195 29 907 A1 (English Translation), Feb. 1997.*

"Concrete Technology" Committee of the Deutscher Beton–Verein e.V., Wiesbaden (1980) (No month).

H. Reul, Handbuch Bauchemie, Verlag FUER Chem. Industrie, Ziolkowsky KG, Augsburg, 1991, (No month).

RAL UZ 64 "Biologisch schnell abbaubare Schmierstoffe und Schaloele" Jun. 1991.

Derwent Patent Abstract (WPAT) No.95–254954/33 (Jul. 1995).

Derwent Patent Abstract (WPAT) No. 97–133791/13 (Feb. 1997).

Derwent Patent Abstract (WPAT) No. 92–151775/19 (Apr. 1992).

Derwent Patent Abstract (WPAT) No. 97–436549/41 (Sep. 1997).

Derwent Patent Abstract (WPAT) No. 91–311302/43 (May 1991).

Derwent Patent Abstract (WPAT) No. 95–254954/33 (Jul. 1995).

Derwent Patent Abstract (WPAT) No. 95–186737/25 (May 1995).

Derwent Patent Abstract (WPAT) No. 95–162610/22 (Apr. 1995).

Derwent Patent Abstract (WPAT) No. 96–069616/08 (Jan. 1996).

Derwent Patent Abstract (WPAT) No. 95–264519/35 (Jul. 1995).

Derwent Patent Abstract (WPAT) No. 89–032811/05 (Feb. 1989).

Derwent Patent Abstract (WPAT) No. 90–109072/15 (Apr. 1990).

* cited by examiner

*Primary Examiner*—Shrive Beck
*Assistant Examiner*—Jennifer Calcagni
(74) *Attorney, Agent, or Firm*—John E. Drach; Glenn E. J. Murphy; Henry E. Millson, Jr.

(57) ABSTRACT

A composition useful as a parting agent for concrete formwork is provided. The composition comprises water; a completely or predominantly unsaturated fatty alcohol containing 6 to 22 carbon atoms and with an iodine value of 40 to 200; and an alkyl or alkenyl oligoglycoside having an alkyl or alkenyl group containing 4 to 22 carbon atoms, a sugar unit containing 5 or 6 carbon atoms and a degree of oligomerization of 1 to 10. The parting agent is particularly storage-stable at low temperatures.

17 Claims, No Drawings

AQUEOUS CONCRETE PARTING AGENTS

This is a National Stage Application of PCT/EP97/04870 filed Sep. 8, 1997.

BACKGROUND OF THE INVENTION

1. Field of the invention

This invention relates to water-based concrete parting agents containing selected oils and emulsifiers, to a process for their production and to the use of the mixtures of selected oils and emulsifiers for the production of water-based concrete parting agents.

2. Discussion of Related Art

Parting agents for concrete formwork and forms are known, for example, from the corresponding guideline of the "Concrete Technology" Committee of the Deutscher Beton-Verein e.V., Wiesbaden (1980) and from H. Reul, Handbuch Bauchemie, Verlag für Chem. Industrie, Ziolkowsky AG, Augsburg, 1991, pages 319 et seq. They are applied to the formwork before the fresh concrete is placed therein and are intended to reduce adhesion between concrete and formwork during stripping and to avoid damage to the concrete surface and to the formwork. This is supposed to increase the number of times the formwork material can be used.

The parting agents generally contain an oil component and various additives, for example rustproofing agents, antioxidants, anti-pore agents, preservatives, wetting agents, coupling agents and emulsifiers. The oil component may be selected from various classes of oils and mixtures thereof, for example mineral oils or white oils, waxes; triglycerides based on vegetable or animal oils or fats or fat derivatives. It is of particular advantage to use the concrete parting agents in the form of an aqueous emulsion. If they are to be used in this form, the parting agents generally contain emulsifiers, such as soaps, ethoxylated fatty acids and ethoxylated alkylphenols or petroleum sulfonates in quantities of about 10 to 30% by weight, based on the oil component. Normally, the parting agents are not delivered to the point of use in the form of an emulsion, but rather in the form of a concentrate which is diluted immediately before use.

The parting agents used today have various disadvantages. Mineral oils or white oils as the oil component are not sufficiently biodegradable. Although triglycerides based on native oils, for example rapeseed oil, are readily biodegradable, they have relatively high viscosities unfavorable for use. In addition, saponification of the oil by alkaline constituents of the concrete can result in the precipitation of calcium soaps, a phenomenon known as "sanding up", which can cause adhesion problems during further processing of the concrete. Fatty acid esters show similar behavior. It has already been proposed to remedy the situation by using distillation residues from the production of fatty alcohols, but unfortunately it has been found that these compounds can only be partly used as the oil component, as described for example in DD-A5 290 439. In this case, the oil component used consists of 80 to 90% by weight of mineral oil with an addition of 4 to 10% by weight of a mixture of saturated and unsaturated wax esters containing 32 to 36 carbon atoms, saturated and unsaturated fatty alcohols containing 24 to 32 carbon atoms and hydrocarbon. In addition, the wax esters present in the mixture can saponify which gives rise to the adhesion problems described above. WO 95/18704 (Henkel) describes concrete parting agents which contain optionally unsaturated fatty alcohols or Guerbet alcohols as oil components and nonionic surfactants in the form of alkylene oxide adducts with suitable H-acid compounds as emulsifiers. European patent application EP-A 0 561 465 discloses mold release agents which contain esters of sterically hindered polyhydric alcohols as compulsory components. The use of monohydric alcohols is described as a way of reducing the emulsifier content. British patent application GB-A 1,294,038 describes a process for the production of concrete parting agents in which monohydric alcohols are used in combination with cationic surfactants.

The emulsifiers used for the production of aqueous emulsions are also not without their problems from the applicational point of view. To produce emulsions, it has hitherto been necessary to use relatively large quantities of emulsifier which, unfortunately, has an adverse effect on the rainproof behavior of the parting agents. In addition, if the emulsifier content is high, re-emulsification can occur at the interface with the alkaline cement, some of the parting agent penetrating into the surface of the concrete. These residues of parting agent can subsequently lead to the above-mentioned problems affecting the adhesion of paints or plasters.

Accordingly, there is a significant demand for concrete parting agents which are readily biodegradable and which have none of the disadvantages of known compounds, such as high viscosity, surface deficiencies or sanding up. Another disadvantage is that, hitherto, known concrete parting agents could at best be assigned to Water Hazard Class 1. The requirements which an environmentally compatible concrete parting agent should satisfy are explained by way of example in RAL UZ 64 "Biologisch schnell abbaubare Schmierstoffe und Schalöle" of June, 1991.

Accordingly, the problem addressed by the present invention was to provide concrete parting agents having improved ecological compatibility which would be distinguished by high resistance to saponification and which would form stable liquid emulsions, even at low temperatures. In addition, the viscosity of the emulsions would be so low that they could be sprayed without difficulty. Finally, the concrete parting agents according to the invention would uniformly wet various formwork materials and would adhere firmly to them.

Other than in the operating examples, or where otherwise indicated, all numbers expressing quantities of ingredients or reaction conditions used herein are to be understood as modified in all instances by the term "about".

DESCRIPTION OF THE INVENTION

The present invention relates to water-based concrete parting agents containing (a) unsaturated fatty alcohols and (b) alkyl and/or alkenyl oligoglycosides.

It has surprisingly been found that the parting agents according to the invention show improved rheology and storage stability compared with the prior art, particularly at low temperatures. The preparations are resistant to saponification, do not sand up, show good wetting behavior and adhere even to the most diverse formwork materials. Another advantage of the new parting agents is that they are ecologically safe and, accordingly, may be assigned to Water Hazard Class 0.

Unsaturated Fatty Alcohols

According to the invention, unsaturated fatty alcohols preferably corresponding to formula (I):

$$R^1OH \quad (I)$$

in which $R^1$ is a completely or predominantly unsaturated hydrocarbon radical containing 6 to 22 and preferably 12 to 18 carbon atoms, are used as oil component (a). Typical examples are palmitoleyl alcohol, oleyl alcohol, elaidyl alcohol, petroselinyl alcohol, linolyl alcohol, linolenyl alcohol, gadoleyl alcohol and erucyl alcohol and the technical mixtures thereof obtained, for example in the high-pressure hydrogenation of technical fatty acid methyl ester fractions with the double bonds intact. Typical methyl ester mixtures which may be used as starting materials for the production of the unsaturated fatty alcohols are those derived from beef tallow, sunflower oil from old and new plants, rapeseed oil from old and new plants, linseed oil, peanut oil and the like. In addition, methyl esters based on predominantly saturated fats and oils, such as palm oil, palm kernel oil and/or coconut oil, may be used providing the products are then correspondingly concentrated, as described for example in DE-C2 43 38 974, DE-A1 43 35 781, DE-A1 44 25 180 and DE-C1 44 22 858 (Henkel). The parting agents according to the invention normally contain unsaturated fatty alcohols which have an iodine value in the range from 40 to 200, preferably in the range from 50 to 150 and more preferably in the range from 70 to 100. The unsaturated fatty alcohols are generally present in quantities of 10 to 50% by weight and preferably in quantities of 20 to 40% by weight, based on the parting agent.

Alkyl and/or alkenyl oligoglycosides

Alkyl and alkenyl oligoglycosides suitable for use as emulsifier component (b) are known nonionic surfactants which correspond to formula (I):

$$R^2O\text{-}[G]_p \qquad \text{(II)}$$

where $R^1$ is an alkyl and/or alkenyl group containing 4 to 22 carbon atoms, G is a sugar unit containing 5 or 6 carbon atoms and p is a number of 1 to 10. They may be obtained by the relevant methods of preparative organic chemistry. EP-A1 0 301 298 and WO 90/03977 are cited as representative of the extensive literature available on this subject.

The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides.

The index p in general formula (II) indicates the degree of oligomerization (DP degree), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a non-whole number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view.

The alkyl or alkenyl group $R^2$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl group $R^2$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ coconut oil fatty alcohol having a DP of 1 to 3 are preferred. The alkyl and/or alkenyl oligoglycosides are normally used in quantities of 0.2 to 5% by weight and preferably in quantities of 0.5 to 2% by weight, based on the parting agent, whereas the parting agents as such have a water content of 50 to 90% by weight, more particularly from 50 to 80% by weight and preferably from 60 to 70% by weight.

Auxiliaries and Additives

The parting agents according to the invention may contain small amounts of typical auxiliaries and additives such as, for example, corrosion inhibitors, antioxidants, anti-pore agents, preservatives, wetting agents, coupling agents and the like. The percentage content of these auxiliaries and additives, based on the parting agent, is normally between 0.1 and 15% by weight and preferably between 0.1 and 5% by weight.

Production of the Parting Agents

The present invention also relates to a process for the production of water-based concrete parting agents in which a water-containing premix of the oil and the emulsifier is initially prepared with moderate stirring and is then homogenized in known manner, for example in an Ultraturrax, a Supraton or any other high-pressure or toothed-ring homogenizer, to form a fine-droplet emulsion.

Commercial Applications

The parting agents may be applied to the formwork surfaces in pure form or in the form of an emulsion by spray-coating, spread-coating or brush-coating. The low-viscosity emulsions are so stable that they can be sprayed without difficulty. Highly viscous pastes can also be applied by knifing. Accordingly, the present invention also relates to the use of mixtures of (a) unsaturated fatty alcohols and (b) alkyl and/or alkenyl oligoglycosides for the production of concrete parting agents used for steel, plastic or wooden formwork in concrete construction.

EXAMPLES

General production procedure. 700 kg of deionized water were heated to 40° C. in a 2 $m^3$ stirred tank reactor, followed by the addition of 10 kg of one of emulsifiers B1 to B3. 1.5 kg of the corrosion inhibitor Texamin® Ke 3161 (cocofatty acid monoethanolamide) were stirred into the transparent, slightly viscous solution formed, a pH value of 10.5 being automatically established. Quantities of 300 kg of oils A1 and A2 were then added with stirring and the premix was adjusted to pH 11.5 with dilute sodium hydroxide solution. After pretreatment in an Ultraturrax, the mixture was transferred to a high-pressure homogenizer where it was processed to a fine-droplet emulsion.

The viscosity of the emulsions was determined by the Brookfield method in an RVT viscosimeter (20° C., spindle 4, 10 r.p.m.). The stability of the emulsions was evaluated after storage for 4 weeks at 5° C. The performance properties of the emulsions are shown in Table 1. Mixture R1 corresponds to the invention while mixtures R2 to R6 are intended for comparison. It can be seen that low-viscosity concrete parting agents resistant to low temperatures are only obtained using the combination according to the invention of a selected oil component and emulsifier.

TABLE 1

Concrete parting agents (quantities in % by weight)

| | R1 | R2 | R3 | R4 | R5 | R6 |
|---|---|---|---|---|---|---|
| A1) Technical oleyl alcohol (IV = 85) | 30 | — | 30 | 30 | — | — |
| A2) Octyl dodecanol | — | 30 | — | — | 30 | 30 |
| B1) Cocalkyl oligoglucoside | 1 | 1 | — | — | — | — |
| B2) Tallow alcohol + 5 EO | — | — | 1 | — | 1 | — |
| B3) Sodium stearate | — | — | — | 1 | — | 1 |
| Water, preservative, corrosion inhibitor | | | to 100 | | | |
| Viscosity [mPas] | 15 | 150 | 200 | 170 | 170 | 200 |
| Stability after storage | Stable | Separated | Separated | Separated | Separated | Separated |
| Water Hazard Class | 0 | 1 | 1 | 1 | 1 | 1 |

What is claimed is:

1. A water-based concrete parting agent, comprising:

(a) a fatty alcohol corresponding to the formula $$R^1OH \quad (I)$$

wherein $R^1$ is a completely or predominantly unsaturated hydrogen radical containing from 6 to 22 carbon atoms and having an iodine value of from 40 to 200, said fatty alcohols present at from 10 to 50% by weight based on the parting agent; and (b) an alkyl or alkenyl oligoglycoside corresponding to the formula $$R^2O\text{-}[G]_p \quad (II)$$

wherein $R^2$ is an alkyl or alkenyl group containing 4 to 22 carbon atoms, G is a sugar unit containing 5 or 6 carbon atoms and p is a number of from 1 to 10, said alkyl or alkenyl oligoglycosides present at from 0.2 to 5% by weight based on the parting agent.

2. The fatty alcohol (I) of claim 1 wherein $R^1$ contains from 12 to 18 carbon atoms.

3. The composition of claim 1 wherein the fatty alcohol (I) are present at from 20 to 40% by weight based on the parting agent.

4. The alkyl or alkenyl oligoglycoside (II) of claim 1 wherein $R^2$ contains 4 to 11 carbon atoms.

5. The alkyl or alkenyl oligoglycoside of claim 4 wherein $R^2$ contains 8 to 10 carbon atoms.

6. The alkyl or alkenyl oligoglycoside (II) of claim 1 wherein $R^2$ contains 12 to 22 carbon atoms.

7. The alkyl or alkenyl oligoglycoside of claim 6 wherein $R^2$ contains 12 to 14 carbon atoms.

8. The composition of claim 1 wherein the alkyl or alkenyl oligoglycoside are present at from 0.5 to 2% by weight based on the parting agent.

9. The composition of claim 1 wherein the water is present at from 50 to 80% by weight of the parting agent.

10. The composition of claim 9 wherein the water is present at from 60 to 70% by weight of the parting agent.

11. The composition of claim 1 further comprising at least one auxiliary comprising corrosion inhibitors, antioxidants, anti-pore agents, preservatives, wetting agents, or coupling agents, said auxiliary being present at from 0.1 to 15% by weight based on the parting agent.

12. The composition of claim 11 wherein at least on auxiliary is present at from 0.1 to 5% by weight based on the parting agent.

13. The composition of claim 1 further comprising from 50 to 90 percent water.

14. A method for reducing the adhesion between formwork and fresh concrete, thereby facilitating the removal of the formwork from cured concrete comprising:

(a) applying a composition of claim 1 to the surface of the formwork;

(b) introducing fresh concrete into the formwork;

(c) allowing the concrete to set or cure; and (d) removing the formwork from the cured concrete.

15. A method of claim 14 wherein the composition of claim 1 is applied to the formwork as an emulsion by spray-coating, spread-coating or brush-coating.

16. The method of claim 14 wherein the composition of claim 1 is applied to the formwork as a paste.

17. The method of claim 14 wherein the formwork is steel, plastic or wooden.

* * * * *